US008377313B2

(12) United States Patent
Domke et al.

(10) Patent No.: US 8,377,313 B2
(45) Date of Patent: Feb. 19, 2013

(54) MAGNETIC HYDROPHOBIC AGGLOMERATES

(75) Inventors: Imme Domke, Jersey City, NJ (US); Hartmut Hibst, Schriesheim (DE); Alexej Michailovski, Ludwigshafen (DE); Norbert Mronga, Dossenheim (DE); Werner Hartmann, Weisendorf (DE); Wolfgang Krieglstein, Rosstal (DE); Vladimir Danov, Erlangen (DE)

(73) Assignees: BASF SE, Ludwigshafen (DE); Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/203,575

(22) PCT Filed: Mar. 3, 2010

(86) PCT No.: PCT/EP2010/052667

§ 371 (c)(1),
(2), (4) Date: Aug. 26, 2011

(87) PCT Pub. No.: WO2010/100180

PCT Pub. Date: Sep. 10, 2010

(65) Prior Publication Data

US 2011/0309003 A1 Dec. 22, 2011

(30) Foreign Application Priority Data

Mar. 4, 2009 (EP) ..... 09154285

(51) Int. Cl.
*B03C 1/005* (2006.01)

(52) U.S. Cl. ..... 210/695; 210/679; 210/714; 210/724; 210/222; 209/5; 209/8; 209/9; 209/39; 209/214; 252/62.51 R

(58) Field of Classification Search ..... 210/679, 210/695, 714, 724, 222; 209/5, 8, 9, 39, 209/214; 252/62.51 R
See application file for complete search history.

(56) References Cited

U.S. PATENT DOCUMENTS

| | | | |
|---|---|---|---|
| 4,643,822 | A | 2/1987 | Parsonage |
| 4,657,666 | A | 4/1987 | Snook et al. |
| 4,834,898 | A | 5/1989 | Hwang |
| 2010/0200510 | A1 | 8/2010 | Domke et al. |
| 2010/0300941 | A1 | 12/2010 | Domke et al. |
| 2010/0307982 | A1 | 12/2010 | Domke et al. |
| 2011/0000826 | A1 | 1/2011 | Diez et al. |
| 2011/0120919 | A1 | 5/2011 | Domke et al. |
| 2011/0120954 | A1 | 5/2011 | Domke et al. |
| 2011/0229384 | A1 | 9/2011 | Michailovski et al. |
| 2011/0240527 | A1 | 10/2011 | Domke et al. |
| 2011/0272623 | A1 | 11/2011 | Domke et al. |
| 2011/0303772 | A1 | 12/2011 | Michailovski et al. |
| 2011/0303773 | A1 | 12/2011 | Domke et al. |
| 2012/0000857 | A1 | 1/2012 | Domke et al. |
| 2012/0058463 | A1 | 3/2012 | Deuerlein et al. |

FOREIGN PATENT DOCUMENTS

| | | |
|---|---|---|
| WO | 2007 008322 | 1/2007 |
| WO | 2009 010422 | 1/2009 |
| WO | 2010 097361 | 9/2010 |

OTHER PUBLICATIONS

Translation of the International Preliminary Report on Patentability for PCT/EP2010/052667, Sep. 4, 2011.*
International Search Report issued May 26, 2010 in PCT/EP10/052667 filed Mar. 3, 2010.

* cited by examiner

*Primary Examiner* — David A Reifsnyder
(74) *Attorney, Agent, or Firm* — Oblon, Spivak, McClelland, Maier & Neustadt, L.L.P.

(57) ABSTRACT

The present invention relates to an agglomerate of at least one particle P which is hydrophobicized on the surface with at least one first surface-active substance and at least one magnetic particle MP which is hydrophobicized on the surface with at least one second surface-active substance, a process for producing it and also the use of these agglomerates.

8 Claims, No Drawings

MAGNETIC HYDROPHOBIC AGGLOMERATES

The present invention relates to an agglomerate of at least one particle P which is hydrophobicized on the surface with at least one first surface-active substance and at least one magnetic particle MP which is hydrophobicized on the surface with at least one second surface-active substance, a process for producing these agglomerates and the use of the agglomerates for separating a particle P from mixtures comprising these particles P and further components.

Agglomerates comprising at least one magnetic particle and at least one further component are already known from the prior art.

U.S. Pat. No. 4,657,666 discloses a process for the enrichment of ores, in which the ore present in the gangue is reacted with magnetic particles to form agglomerates as a result of the hydrophobic interactions. The magnetic particles are hydrophobicized on the surface by treatment with hydrophobic compounds so that binding to the ore occurs. The agglomerates are then separated off from the mixture by means of a magnetic field. Said document also discloses that the ores are treated with a surface-activating solution of 1% of sodium ethylxanthogenate before the magnetic particle is added.

U.S. Pat. No. 4,834,898 discloses a process for separating off nonmagnetic materials by bringing them into contact with magnetic reagents which are enveloped by two layers of surface-active substances. U.S. Pat. No. 4,834,898 further discloses that the surface charge of the nonmagnetic particles which are to be separated off can be influenced by various types and concentrations of electrolyte reagents. For example, the surface charge is altered by addition of multivalent anions, for example tripolyphosphate ions.

WO 2007/008322 A1 discloses a magnetic particle which is hydrophobicized on the surface for separating off impurities from mineral substances by magnetic separation processes. According to WO 2007/008322 A1, a dispersant selected from among sodium silicate, sodium polyacrylate and sodium hexametaphosphate can be added to the solution or dispersion.

It is an object of the present invention to provide agglomerates of at least one magnetic particle and at least one further particle, with the at least one further particle preferably being a component of value. Furthermore, the agglomerates of the invention should have a high stability in water or polar media but be unstable in nonpolar media.

Furthermore, these agglomerates should have hydrophobic character. A further object of the present invention is to provide corresponding agglomerates which, owing to their magnetic properties, can be separated off from further, nonmagnetic and nonhydrophobic components by means of a magnetic field.

These objects are achieved according to the invention by agglomerates of at least one particle P which is hydrophobicized on the surface with at least one first surface-active substance and at least one magnetic particle MP which is hydrophobicized on the surface with at least one second surface-active substance.

Furthermore, these objects are also achieved by a process for producing these agglomerates and by the use of the agglomerates for separating a particle P from mixtures comprising these particles P and further components.

For the purposes of the present invention, "hydrophobic" means that the corresponding particle can be hydrophobicized subsequently by treatment with the at least one surface-active substance. It is also possible for an intrinsically hydrophobic particle to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

At least one particle P which is hydrophobicized on the surface with at least one first surface-active substance is present in the agglomerates of the invention.

In a preferred embodiment of the agglomerate of the invention, the at least one particle P comprises at least one metal compound and/or coal.

The at least one particle P particularly preferably comprises a metal compound selected from the group consisting of sulfidic ores, oxidic and/or carbonate-comprising ores, for example azurite $[Cu_3(CO_3)_2(OH)_2]$ or malachite $[Cu_2[(OH)_2|CO_3]]$, and noble metals and compounds thereof. In a very particularly preferred embodiment, the at least one particle P consists of the metal compounds mentioned.

Examples of sulfidic ores which can be used according to the invention are, for example, selected from the group of copper ores consisting of covellite CuS, molybdenum(IV) sulfide, chalcopyrite (copper pyrite) $CuFeS_2$, bornite $Cu_5FeS_4$, chalcocyte (copper glance) $Cu_2S$, sulfides of iron, lead, zinc or molybdenum, i.e. $FeS/FeS_2$, PbS, ZnS or $MoS_2$ and mixtures thereof.

Suitable oxidic compounds are those of metal and semimetals, for example silicates or borates or other salts of metals and semimetals, for example phosphates, sulfates or oxides/hydroxides/carbonates and further salts, for example azurite $[Cu_3(CO_3)_2(OH)_2]$, malachite $[Cu_2[(OH)_2(CO_3)]]$, barite $(BaSO_4)$, monazite $((La—Lu)PO_4)$.

Examples of suitable noble metals are Au, Pt, Pd, Rh etc., with Pt occurring mainly in alloyed form. Suitable Pt/Pd ores are sperrylite $PtAs_2$, cooperite PtS or braggite (Pt,Pd,Ni)S.

According to the invention, the at least one particle P present in the agglomerate of the invention is hydrophobicized on the surface with at least one first surface-active substance and the at least one magnetic particle MP is hydrophobicized with at least one second surface-active substance. In one embodiment of the agglomerate of the invention, the at least one first surface-active substance and the at least one second surface-active substance are different. In a further embodiment of the agglomerate of the invention, the at least one first surface-active substance and the at least one second surface-active substance are identical.

In a preferred embodiment of the present invention, a "surface-active substance" is a substance which is able to alter the surface of the particle P in such a way that it becomes hydrophobic in the sense of the abovementioned definition.

As at least one first surface-active substance, preference is given to using a compound of the general formula (I)

$$A\text{-}Z \qquad (I)$$

where

A is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Z is a group by means of which the compound of the general formula (I) binds to the at least one particle P.

In a particularly preferred embodiment, A is a linear or branched $C_4$-$C_{12}$-alkyl, very particularly preferably a linear $C_4$- or $C_8$-alkyl. Any heteroatoms present according to the invention are selected from among N, O, P, S and halogens such as F, Cl, Br and I.

In a further preferred embodiment, A is preferably a linear or branched, preferably linear, $C_6$-$C_{20}$-alkyl. Furthermore, A is preferably a branched $C_6$-$C_{14}$-alkyl, with the at least one substituent, which preferably has from 1 to 6 carbon atoms, preferably being present in the 2 position, for example 2-ethylhexyl and/or 2-propylheptyl.

In a further particularly preferred embodiment, Z is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—PO_3^{2-}$ $—(X)_n—CO_2^-$, $—(X)_n—CS_2^-$, $—(X)_n—COS^-$, $—(X)_n—C(S)NHOH$, $—(X)_n—S^-$, where X is selected from the group consisting of O, S, NH, $CH_2$ and n=0, 1 or 2, with, if appropriate, cations selected from the group consisting of hydrogen, $NR_4^+$, where the radicals R are each, independently of one another, hydrogen and/or $C_1$-$C_8$-alkyl, alkali metals or alkaline earth metals. The anions mentioned and the corresponding cations form, according to the invention, uncharged compounds of the general formula (I).

If n in the abovementioned formulae is 2, then two identical or different, preferably identical, groups A are bound to a group Z.

In a particularly preferred embodiment, use is made of compounds selected from the group consisting of xanthates $A—O—CS_2^-$, dialkyldithiophosphates $(A—O)_2—PS_2^-$, dialkyldithiophosphinates $(A)_2—PS_2^-$ and mixtures thereof, where the radicals A are each, independently of one another, a linear or branched, preferably linear, $C_6$-$C_{20}$-alkyl, for example n-octyl, or a branched $C_6$-$C_{14}$-alkyl, with the branching point preferably being in the 2 position, for example 2-ethylhexyl and/or 2-propylheptyl.

Counterions present in these compounds are preferably cations selected from the group consisting of hydrogen, $NR_4^+$, where the radicals R are each, independently of one another, hydrogen and/or $C_1$-$C_8$-alkyl, alkali metals or alkaline earth metals, in particular sodium or potassium.

Very particularly preferred compounds of the general formula (I) are selected from the group consisting of sodium or potassium n-octylxanthate, sodium or potassium butylxanthate, sodium or potassium di-n-octyldithiophosphinate, sodium or potassium di-n-octyldithiophosphate, octanethiol and mixtures of these compounds.

In the case of noble metals, for example Au, Pd, Rh, etc., particularly preferred surface-active substances are xanthates, thiocarbamates or hydroxamates. Further suitable surface-active substances are described, for example, in EP 1200408 B1.

In the case of metal oxides, for example FeO(OH), $Fe_3O_4$, ZnO, etc., carbonates, for example azurite $[Cu(CO_3)_2(OH)_2]$, malachite $[Cu_2[(OH)_2CO_3]]$, particularly preferred surface-active substances are octylphosphonic acid (OPA), $(EtO)_3Si$-A, $(MeO)_3Si$-A, with the abovementioned meanings for A.

In the case of metal sulfides, for example $Cu_2S$, $MoS_2$, etc., particularly preferred surface-active substances are monothiols, dithiols and trithiols or xanthogenates.

In a further preferred embodiment of the process of the invention, Z is $—(X)_n—CS_2^-$, $—(X)_n—PO_2^-$ or $—(X)_n—S^-$, where X is O and n is 0 or 1, and the cation is selected from among hydrogen, sodium and potassium. Very particularly preferred surface-active substances are 1-octanethiol, potassium n-octylxanthate, potassium butylxanthate, octylphosphonic acid and compounds of the following formula (IV)

(IV)

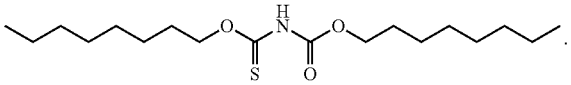

Particular preference is given to at least one particle P which is hydrophobicized with at least one surface-active substance being present in the agglomerate of the invention. P is particularly preferably $Cu_2S$ which is hydrophobicized with the potassium salts of ethylxanthogenate, butylxanthogenate, octylxanthogenate or other aliphatic or branched xanthogenates or mixtures thereof. Furthermore, particular preference is given to the particle P being a Pd-comprising alloy which is preferably hydrophobicized with the potassium salts of ethylxanthogenate, butylxanthogenate, octylxanthogenate or other aliphatic or branched xanthogenates or mixtures thereof, with this particle very particularly preferably being hydrophobicized with mixtures of these potassium xanthates and thiocarbamates. In general, preference is given to agglomerates in which the particle P comprises Rh, Pt, Pd, Au, Ag, Ir or Ru. The surface-active hydrophobicization is matched to the respective mineral surface so that optimal interaction between surface-active substance and the particle P comprising Rh, Pt, Pd, Au, Ag, Ir or Ru occurs.

Methods of hydrophobicizing the surface of the particles P which can be used in the agglomerates of the invention are known to those skilled in the art, for example contacting of the particles P with the at least one first surface-active substance, for example in bulk or in dispersion. For example, the particles P and the at least one surface-active substance are combined in the appropriate amounts without any further dispersant and mixed. Suitable mixing apparatuses are known to those skilled in the art, for example mills such as ball mills (planetary vibratory mills).

In a further embodiment, the components are combined in a dispersion, preferably in suspension. Suitable dispersants are, for example, water, water-soluble organic compounds, for example alcohols having from 1 to 4 carbon atoms, and mixtures thereof.

The at least one surface-active substance is generally present on the at least one particle P in an amount of from 0.01 to 5% by weight, preferably from 0.01 to 0.1% by weight, based on the sum of at least one first surface-active substance and at least one particle P. The optimum content of surface-active substance generally depends on the size of the particles P.

The particles P can generally have a regular shape, for example spherical, cylindrical, cuboidal, or irregular shape, for example chip-shaped.

According to the invention, it is possible for the particle P to be joined to at least one further particle $P_2$. Particle $P_2$ can be selected from the group mentioned for particle P. Particle $P_2$ can also be selected from the group consisting of oxidic metal or semimetal compounds, for example $SiO_2$.

The at least one particle P which is hydrophobicized on the surface with at least one first surface-active substance generally has a diameter of from 1 nm to 10 mm, preferably from 10 to 100 μm. In the case of unsymmetrically shaped particles, the diameter is considered to be the longest dimension of the particle.

The agglomerate of the invention further comprises at least one magnetic particle MP which is hydrophobicized on the surface with at least one second surface-active substance.

In general, it is possible to use all magnetic substances and materials known to those skilled in the art as magnetic particles MP. In a preferred embodiment, the at least one magnetic particle MP is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (II)

$$M^{2+}{}_{x}Fe^{2+}{}_{1-x}Fe^{3+}{}_{2}O_4 \quad \text{(II)}$$

where

M is selected from among Co, Ni, Mn, Zn and mixtures thereof and x is $\leqq 1$, hexagonal ferrites, for example barium or strontium ferrite $MFe_6O_{19}$ where M=Ca, Sr, Ba, and mixtures thereof. The magnetic particles MP can additionally have an outer layer, for example of $SiO_2$.

In a particularly preferred embodiment of the present invention, the at least one magnetic particle MP is iron, magnetite or cobalt ferrite $Co^{2+}{}_{x}Fe^{2+}{}_{1-x}Fe^{3+}{}_{2}O_4$ where $x \leqq 1$.

The magnetic particles MP can generally have a regular shape, for example spherical, cylindrical, cuboidal, or irregular shape, for example chip-shaped.

The at least one magnetic particle MP which is hydrophobicized on the surface with at least one second surface-active substance generally has a diameter of from 10 nm to 1000 mm, preferably from 100 nm to 1 mm, particularly preferably from 500 nm to 500 μm, very particularly preferably from 1 to 100 μm. In the case of unsymmetrically shaped magnetic particles, the diameter is considered to be the longest dimension present in the particle.

Particular preference is given to using magnetic particles MP which have a particle size distribution similar to that of the particles P. These size distributions can be monomodal, bimodal or trimodal.

The magnetic particles MP can, if appropriate, be converted into the appropriate size by methods known to those skilled in the art, for example by milling, before being used according to the invention.

The magnetic particles MP which can be used according to the invention preferably have a specific BET surface area of from 0.01 to 50 $m^2/g$, particularly preferably from 0.1 to 20 $m^2/g$, very particularly preferably from 0.2 to 10 $m^2/g$.

The magnetic particles MP which can be used according to the invention preferably have a density (measured in accordance with DIN 53193) of from 3 to 10 $g/cm^3$, particularly preferably from 4 to 8 $g/cm^3$.

The at least one magnetic particle MP present in the agglomerates of the invention is hydrophobicized on the surface with at least one second surface-active substance. The at least one second surface-active substance is preferably selected from among compounds of the general formula (III)

$$B—Y \quad \text{(III)},$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Y is a group by means of which the compound of the general formula (III) binds to the at least one magnetic particle MP.

In a particularly preferred embodiment, B is a linear or branched $C_6$-$C_{18}$-alkyl, preferably linear $C_8$-$C_{12}$-alkyl, very particularly preferably a linear $C_{12}$-alkyl. Any heteroatoms present according to the invention are selected from among N, O, P, S and halogens such as F, Cl, Br and I.

In a further particularly preferred embodiment, Y is selected from the group consisting of $—(X)_n—SiHal_3$, $—(X)_n—SiHHal_2$, $—(X)_n—SiH_2Hal$ where Hal is F, Cl, Br, I, and anionic groups such as $—(X)_n—SiO_3^{3-}$, $—(X)_n—CO_2^-$, $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—CO_2^-$, $—(X)_n—CS_2^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4^+$ where the radicals R are each, independently of one another, hydrogen and/or $C_1$-$C_8$-alkyl, an alkali metal or alkaline earth metal or zinc, also $—(X)_n—Si(OZ)_3$ where n=0, 1 or 2 and Z=a charge, hydrogen or a short-chain alkyl radical.

If n=2 in the formulae mentioned, two identical or different, preferably identical, groups B are bound to a group Y.

Very particularly preferred hydrophobicizing substances of the general formula (III) are alkyltrichlorosilanes (alkyl group having 6-12 carbon atoms), alkyltrimethoxysilanes (alkyl group having 6-12 carbon atoms), octylphosphonic acid, lauric acid, oleic acid, stearic acid and mixtures thereof.

The at least one second surface-active substance is preferably present on the at least one magnetic particle MP in an amount of from 0.01 to 0.1% by weight, based on the sum of at least one second surface-active substance and at least one magnetic particle MP. The optimal amount of at least one second surface-active substance is dependent on the size of the magnetic particle MP.

Magnetite hydrophobicized with dodecyltrichlorosilane and/or magnetite hydrophobicized with octylphosphonic acid is particularly preferably present in the agglomerate of the invention as at least one magnetic particle MP which is hydrophobicized with at least one second surface-active substance.

The magnetic particles MP which are hydrophobicized with at least one second surface-active substance can be produced by all methods known to those skilled in the art, preferably as has been described for the hydrophobicized particles P.

In the agglomerate of the invention, the at least one particle P which is hydrophobicized on the surface with at least one first surface-active substance and the at least one magnetic particle MP which is hydrophobicized on the surface with at least one second surface-active substance can generally be present in any ratios.

In a preferred embodiment of the agglomerate of the invention, the at least one particle P which is hydrophobicized on the surface with at least one first surface-active substance is present in a proportion of from 10 to 90% by weight, preferably from 20 to 80% by weight, particularly preferably from 40 to 60% by weight, and the at least one magnetic particle MP which is hydrophobicized on the surface with at least one second surface-active substance is present in a proportion of from 10 to 90% by weight, preferably from 20 to 80% by weight, particularly preferably from 40 to 60% by weight, in each case based on the total agglomerate, with the sum in each case being 100% by weight. In a particularly preferred embodiment, 50% by weight of at least one particle P which is hydrophobicized on the surface with at least one first surface-active substance and 50% by weight of at least one magnetic particle MP which is hydrophobicized on the surface with at least one second surface-active substance are present in the agglomerate of the invention. Care should be taken to ensure that, depending on the magnetic properties of the magnetic particles MP, the agglomerate as a whole can still be magnetically deflected under the action of an external magnetic field. The ratio of P to MP is particularly preferably chosen so that an external magnetic field (which can be produced, for example, by means of a strong CoSm permanent magnet) can magnetically deflect these particles when the agglomerates flow past at 300 mm/sec at an angle of 90° to the external magnet. Furthermore, it is very particularly preferred that the hydrophobic interactions between P and MP are strong enough for them not to be torn apart at this flow velocity.

The bond between the at least one particle P which is hydrophobicized on the surface with at least one first surface-active substance and the at least one magnetic particle which is hydrophobicized on the surface with at least one second surface-active substance in the agglomerate of the invention is produced by hydrophobic interactions.

The diameter of the agglomerates of the invention depends on the percentages of the particles P and the magnetic particles MP, the diameters of the particles P and magnetic particles MP and also the interstices between the particles, which depend on the type and amount of the surface-active substances.

The agglomerates of the invention are generally sufficiently magnetic that an external magnetic field, which can be produced, for example, by means of a strong CoSm permanent magnet, can at least still magnetically deflect these agglomerates when the agglomerates flow past at 300 mm/sec at an angle of 90° to the external magnet. The hydrophobic interactions between P and MP within the agglomerates are generally strong enough for them to remain stable, i.e. not to be torn apart, at the flow velocity mentioned.

In general, the agglomerates of the invention can be dissociated in a nonpolar medium, for example diesel or acetone, preferably without the at least one particle P or the at least one magnetic particle MP being destroyed.

The agglomerates of the invention can, for example, be produced by contacting of the particles P hydrophobicized with the at least one first surface-active substance and the magnetic particles MP hydrophobicized with the at least one second surface-active substance, for example in bulk or in dispersion. For example, the hydrophobicized particles P and the hydrophobicized magnetic particles MP are combined and mixed in the appropriate amounts without a further dispersion medium. In a further embodiment, the particles P and the magnetic particles MP of which only one is hydrophobicized are combined and mixed in the appropriate amounts in the presence of the surface-active substance for the not yet hydrophobicized particle without a further dispersion medium. In a further embodiment, the particles P and the magnetic particles MP which are both not yet hydrophobicized are combined and mixed in the appropriate amounts in the presence of the at least one first surface-active substance and the at least one second surface-active substance without a further dispersion medium. Suitable mixing apparatuses are known to those skilled in the art, for example mills such as a ball mill.

Furthermore, the abovementioned processes can also be carried out in the presence of a suitable dispersion medium.

Dispersion media which are suitable for the process of the invention are, for example, water, water-soluble organic compounds, for example alcohols having from 1 to 4 carbon atoms, and mixtures thereof.

The present invention therefore also provides a process for producing agglomerates according to the invention, which comprises contacting the particles P hydrophobicized with the at least one first surface-active substance and the magnetic particles MP hydrophobicized with the at least one second surface-active substance to give the agglomerates.

The process of the invention is generally carried out at a temperature of from 5 to 50° C., preferably at ambient temperature.

The process of the invention is generally carried out at atmospheric pressure.

After the agglomerates of the invention have been obtained, these can be separated off from any solvent or dispersion medium present by methods known to those skilled in the art, for example by filtration, decantation, sedimentation and/or magnetic processes.

The agglomerates of the invention can be used for separating corresponding particles P from mixtures comprising these particles P and further components. For example, the particles P can be an ore and the further components can be the gangue. After formation of the agglomerates according to the invention by addition of the magnetic particles MP to the mixture comprising the particles P, these agglomerates can be separated off from the mixture, for example by application of a magnetic field. After having been separated off, the agglomerates can be dissociated by methods known to those skilled in the art.

The present invention therefore also provides for the use of the agglomerates of the invention for separating a particle P from mixtures comprising these particles P and further components, for example for separating ores of value from crude ores comprising the gangue.

EXAMPLES 3 g of magnetite ($Fe_3O_4$, diameter 4 μm) are stirred vigorously with 0.5% by weight of octylphosphonic acid in 30 ml of water for half an hour (200 rpm). The liquid constituents are subsequently removed under reduced pressure. 100 g of an ore mixture comprising 0.7% by weight of sulfidic Cu are then added. The main constituent of this ore mixture is $SiO_2$. 1 kg/t of octylxanthate is added to this ore mixture and the hydrophobicized magnetite, and the mixture is treated in a planetary ball mill (200 rpm using 180 ml of $ZrO_2$ balls having a diameter of 1.7-2.3 mm) for 5 minutes. The system is subsequently poured into water. In this medium, the hydrophobic agglomerates of the invention between the hydrophobic magnetite and the selectively hydrophobicized copper sulfide are formed. These agglomerates can be held by means of a strong permanent magnet at flow velocities of greater than 320 mm/sec. perpendicular to the magnet without the hydrophobic agglomerates being destroyed.

The invention claimed is:

1. An agglomerate comprising:

at least one particle P, which is hydrophobicized on a surface with at least one first surface-active substances and at least one magnetic particle MP, which is hydrophobicized on the surface with at least one second surface-active substance, wherein the at least one first surface-active substance comprises a compound of formula (I)

$$A\text{-}Z \qquad (I),$$

wherein

A is selected from the group consisting of a linear or branched $C_3$-$C_{30}$-alkyl, a $C_3$-$C_{30}$-heteroalkyl, a substituted $C_6$-$C_{30}$-aryl, a substituted $C_6$-$C_{30}$-heteroalkyl, and a $C_6$-$C_{30}$-aralkyl, and Z is at least one anionic group selected from the group consisting of $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_3^{2-}—(X)_n—CO_2^-$, $—(X)_n—CS_2^-$, $—(X)_n—COS^-$, $—(X)_n—C(S)NHOH$, and $—(X)_n—S^-$, wherein X is selected from the group consisting of O, S, NH, and $CH_2$, n=0, 1 or 2, and Z optionally further comprises at least one cation selected from the group consisting of hydrogen, $NR_4^+$, where the radicals, R, are each, independently of one another, selected from the group consisting of a hydrogen and a $C_1$-$C_8$-alkyl, an alkali metal, and an alkaline earth metal, and the at least one second surface-active substance comprises a compound of formula (III)

$$B—Y \quad (III),$$

wherein

B is selected from the group consisting of a linear or branched $C_3$-$C_{30}$-alkyl, a $C_3$-$C_{30}$-heteroalkyl, a substituted $C_6$-$C_{30}$-aryl, a substituted $C_6$-$C_{30}$-heteroalkyl, and a $C_6$-$C_{30}$-aralkyl, and Y is a group that binds by means of which the compound of formula (III) to the at least one magnetic particle MP.

2. The agglomerate to of claim 1, wherein the at least one particle P comprises at least one selected from the group consisting of a metal compound and a coal.

3. The agglomerate of claim 1, wherein the at least one magnetic particle MP is selected from the group consisting of a magnetic metal and mixtures thereof, a ferromagnetic alloy of a magnetic metal and mixtures thereof, a magnetic iron oxide, a cubic ferrite of formula (II)

$$M^{2+}_xFe^{2+}_{1-x}Fe^{3+}_2O_4 \quad (II)$$

wherein

M is at least one metal selected from the group consisting of Co, Ni, Mn, and Zn, and x is $\leqq 1$, and a hexagonal ferrite and mixtures thereof.

4. The agglomerate of claim 1, wherein the at least one particle P is present in a proportion of from 10 to 90% by weight, and the at least one magnetic particle MP is present in a proportion of from 10 to 90% by weight, in each case based on a total agglomerate, with the sum in each case being 100% by weight.

5. A process for producing the agglomerate of claim 1, comprising contacting the at least one particle P hydrophobicized with the at least one first surface-active substance and the at least one magnetic particle MP hydrophobicized with the at least one second surface-active substance to form the agglomerate.

6. The agglomerate of claim 1, wherein Z further comprises at least one cation selected from the group consisting of hydrogen, $NR_4^+$, where the radicals, R, are each, independently of one another, selected from the group consisting of a hydrogen and a $C_1$-$C_8$-alkyl, an alkali metal, and an alkaline earth metal.

7. A method for separating a particle P from a mixture comprising the particle P and at least one further component, the method comprising adding the at least one magnetic particle MP to the mixture to form the agglomerate of claim 1 comprising the particle P, and separating the agglomerate of claim 1 from the mixture.

8. The method of claim 7, further comprising dissociating the agglomerate.

* * * * *